United States Patent [19]

Tam et al.

[11] Patent Number: 4,937,163

[45] Date of Patent: Jun. 26, 1990

[54] IMAGING MEMBER AND PROCESSES THEREOF

[75] Inventors: Man C. Tam, Mississauga; Arnold L. Pundsack, Georgetown, both of Canada

[73] Assignee: Xerox Corporation, Stamford, Conn.

[21] Appl. No.: 302,512

[22] Filed: Jan. 27, 1989

[51] Int. Cl.[5] ..... G03G 13/22

[52] U.S. Cl. ..... 430/41; 430/67; 430/96

[58] Field of Search ..... 430/41, 67, 96

[56] References Cited

U.S. PATENT DOCUMENTS

| | | | |
|---|---|---|---|
| 3,634,336 | 1/1972 | Perez-Albuerne | 252/519 |
| 3,681,070 | 8/1972 | Timmerman et al. | 96/1.5 |
| 3,689,468 | 9/1972 | Cenci et al. | 260/86.1 |
| 4,010,117 | 3/1987 | Maruhashi et al. | 252/500 |
| 4,148,639 | 4/1979 | Sinkovitz et al. | 96/1.5 R |
| 4,391,888 | 7/1983 | Chang et al. | 430/57 |
| 4,407,918 | 10/1983 | Sato | 430/54 |
| 4,426,435 | 1/1984 | Oka | 430/132 |
| 4,496,642 | 1/1985 | Tam et al. | 430/41 |
| 4,517,271 | 5/1985 | Hirooka et al. | 430/94 |
| 4,518,668 | 5/1985 | Nakayama | 430/49 |
| 4,520,089 | 5/1985 | Tazuki et al. | 430/49 |
| 4,533,611 | 8/1985 | Winkelmann et al. | 430/49 |
| 4,536,457 | 8/1985 | Tam | 430/41 |
| 4,536,458 | 8/1985 | Ng | 430/41 |

*Primary Examiner*—John L. Goodrow

*Attorney, Agent, or Firm*—E. O. Palazzo

[57] ABSTRACT

An imaging member comprised of an ionically conductive film forming polymer, such as sulfonated polystyrene, and an electrically insulating softenable layer comprising a fracturable layer containing electrically photosensitive migration marking particles.

60 Claims, 3 Drawing Sheets

IMAGING MEMBER AND PROCESSES THEREOF

BACKGROUND OF THE INVENTION

This invention relates generally to imaging members, and more specifically to an improved migration imaging member and processes thereof. In one embodiment, the present invention relates to migration imaging members with an electrically conductive layer, such as a substantially transparent electrically conductive layer or electrode comprised of an ionically conductive film forming polymer. One specific imaging member of the present invention is comprised of a supporting substrate, a substantially transparent electrically conductive polymer, and at least one imaging layer comprised of a film forming polymer, or softenable layer, and electrically photosensitive particles. The imaging members of the present invention may also include a protective overcoating thereon. With further respect to the present invention, the imaging members thereof can be selected generally for electrophotographic imaging processes including information recording and storage, xerography, printing and duplicating processes. Specifically, the imaging members of the present invention can be selected for migration imaging processes, reference U.S. Pat. No. 4,536,457, the disclosure of which is totally incorporated herein by reference, xerography and xeroprinting-/duplicating processes. Advantages of the imaging members of the present invention include, for example, a significant reduction in residual background optical density of the imaged members by eliminating the use of costly and disadvantageous metal electrodes such as aluminum, improved adhesion, and the like. With the imaging members of the present invention, the background optical density is reduced, for example, from about 0.3 for prior art imaging members to about 0.08 in some embodiments. Also, with the imaging members of the present invention, reproducible, stable and uniform optical density of the electrically conductive layer can be more easily achieved than when metals such as aluminum are selected, thus enabling improved image quality. Further, the electrically conductive layer selected for the imaging members of the present invention is not subject to undesirable oxidation as is the situation with metals such as aluminum. Also, with some embodiments of the present invention the imaging members possess $D_{min}$ comparable to conventional silver halide films, and moreover the imaging members of the present invention are more economical in many instances as compared to prior art imaging members in that there is eliminated the costly aluminizing step selected for the supporting substrate of such members, for example, aluminizing can add up to 11 cents per square foot to the cost of the resulting film, while with the selection of the transparent conductive polymers of the present invention as the electrode, the comparable cost is about 1 cent for such polymers. Cost can be an important factor particularly when selecting the imaging member as film intermediates and in printing processes.

Other U.S. patents of interest include No. 4,391,388; 4,426,435; 4,517,271; 4,407,918; 4,518,668; 4,520,089; 4,533,611 and No. 4,536,458. The aforementioned patents and No. 4,536,457 mentioned herein were located as a result of a patentability search.

Migration imaging systems capable of producing high quality images of high optical contrast density, continuous tone and high resolution are known references, for example U.S. Pat. Nos. 3,909,262 and 3,975,195, the disclosures of which are totally incorporated herein by reference. Other similar imaging members are illustrated in U.S. Pat. No. 4,536,457, the disclosure of which is totally incorporated herein by reference, including the background of the invention. In a typical embodiment of these migration imaging systems, a migration imaging member comprising an aluminized substrate, reference the U.S. Pat. No. 4,536,457, a layer of softenable material and photosensitive marking material is imaged by first forming a latent image by electrically charging the member and exposing the charged member to a pattern of activating electromagnetic radiation such as light. Where the photosensitive marking material is originally in the form of a fracturable layer contiguous to the upper surface of the softenable layer, the marking particles in the exposed area of the member migrate in depth toward the substrate when the member is developed by softening the softenable layer.

Various known means for developing the latent images formed with migration imaging systems may be selected including those illustrated in U.S. Pat. No. 4,536,457. These development methods include solvent wash away, solvent vapor softening, heat softening, and combinations of these methods, as well as any other method which changes the resistance of the softenable material to the migration of particulate marking material through the softenable layer to allow imagewise migration of the particles in depth toward the substrate. In the solvent wash away or meniscus development method, the migration marking material in the light struck region migrates toward the substrate through the softenable layer, which is softened and dissolved, and repacks into a more or less monolayer configuration. In migration imaging films supported by aluminized polyester substrate, this region exhibits a maximum optical density which can be as high as the initial optical density of the unprocessed film. In contrast, the migration marking material in the unexposed region is substantially washed away and this region exhibits a minimum optical density of about 0.2, which is essentially due to the aluminized polyester substrate. Therefore, the image sense of the developed image is sign-reversed, that is positive to negative or vice versa. Various methods and materials, and combinations thereof have previously been used to avoid such unfixed migration images.

In the heat, or vapor softening developing modes, the migration marking material in the light struck region disperses in the depth of the softenable layer after development and this region exhibits a $D_{min}$ which is typically in the range of from about 0.6 to about 0.7. This relatively high $D_{min}$ is believed to be a direct consequence of the depthwise dispersion of the otherwise unchanged migration marking material. Also, the migration marking material in the unexposed region does not migrate and substantially remains in the original configuration, that is a monolayer. This region exhibits a maximum optical density ($D_{max}$) which is typically in the range of from about 1.8 to about 1.9. Therefore, the image sense of the heat or vapor developed images is sign retained, that is positive-to-positive or negative-to-negative. Techniques have been devised to permit optically sign-reversed imaging with vapor development, but these techniques are generally complex and require critically controlled processing conditions. An example of such techniques can be located in U.S. Pat. No. 3,795,512.

For many imaging applications, it is desirable to generate negative images from a positive original or positive images from a negative original, that is optically sign-reversed imaging, preferably with low minimum optical density ($D_{min}$). Although the meniscus or solvent wash away development methods permit optically sign-reversed images with low minimum optical density, they involve removal of materials from the migration imaging member leaving the migration image largely or totally unprotected from abrasion. Further, although various methods and materials have previously been used to overcoat such unfixed migration images, the post-development overcoating step is impractically costly and inconvenient for the end users. Also, disposal of the effluents washed from the migration imaging member during development is required. While heat or vapor development methods are preferred because they are rapid, essentially dry and produce no liquid effluents, the image sense of the heat or vapor developed images is optically sign-retaining and the minimum optical density is relatively high, for example from about 0.6 to about 0.7.

The background portions of an imaged member may sometimes be transparentized by means of an agglomeration and coalescence effect. In this system, an imaging member comprising a softenable layer containing a fracturable layer of electrically photosensitive migration marking material is imaged in one process mode by electrostatically charging the member, exposing the member to an imagewise pattern of activating electromagnetic radiation, and the softenable layer softened by exposure for a few seconds to a solvent vapor thereby causing a selective migration in depth of the migration material in the softenable layer in the areas which were previously exposed to the activating radiation. The vapor developed image is then subjected to a heating step. Since the exposed particles gain a substantial net charge (typically 85 to 90 percent of the deposited surface charge) as a result of light exposure, they migrate substantially in depth in the softenable layer towards the substrate when exposed to a solvent vapor, thus causing a drastic reduction in optical density. The optical density in this region is typically from about 0.7 to 0.9 after vapor exposure compared with an initial value of about 1.8 to 1.9. In the unexposed region, the surface charge becomes discharged due to vapor exposure. The subsequent heating step causes the unmigrated, uncharged migration material in unexposed areas to agglomerate or flocculate, often accompanied by coalescence of the marking material particles thereby resulting in a migration image of very low minimum optical density (in the unexposed areas) in the 0.25 to 0.35 range. Thus, the contrast density of the final image is typically from about 0.35 to 0.65. Alternatively, the migration image may be formed by heat followed by exposure to solvent vapors and a second heating step which also results in a migration image with very low minimum optical density. In this imaging system and the heat or vapor development techniques, the softenable layer remains substantially intact after development with the image being self-fixed as the marking material particles are trapped within the softenable layer. Although the minimum optical density ($D_{min}$) of images using such techniques is much reduced, there is generally a concurrent drastic reduction in the maximum optical density ($D_{max}$) (since these areas consist of marking material particles which have migrated substantially in depth) and consequently the contrast density ($D_{max}$-$D_{min}$) is also low.

Generally, the softenable layer of migration imaging members is characterized by sensitivity to abrasion and foreign contaminants. Since a fracturable layer is located at or close to the surface of the softenable layer, abrasion can readily remove some of the fracturable layer during either manufacturing or use of the film and adversely affect the final image. Foreign contamination such as finger prints can also cause defects to appear in any final image. Moreover, the softenable layer tends to cause blocking of migration imaging members when multiple members are stacked or when the migration imaging material is wound into rolls for storage or transporation. Blocking is the adhesion of adjacent objects to each other. Blocking usually results in damage to the objects when they are separated.

The sensitivity to abrasion and foreign contaminants can be reduced by forming an overcoating such as the overcoatings described in U.S. Pat. No. 3,909,262, the disclosure of which is totally incorporated herein by reference. However, since the migration imaging mechanisms for each development method are different and because they depend on the electrical properties of the surface of the softenable layer and on the complex interplay of the various electrical processes involving charge injection from the surface, charge transport through the softenable layer, charge capture by the photosensitive particles and charge ejection from the photosensitive particles, application of an overcoat to the softenable layer often causes changes in the delicate balance of these processes, and results in degraded photographic characteristics compared with the nonovercoated migration imaging member. Notably, the photographic contrast density is degraded. Recently, improvements in migration imaging members and processes for forming images on these migration imaging members have been achieved. These improved migration imaging members and processes are described in U.S. Pat. Nos. 4,536,458 and 4,536,457, the disclosures of which are totally incorporated herein by reference.

In the aforesaid U.S. Pat. No. 4,536,457, there is disclosed, for example, a process wherein a migration imaging member comprising a substrate and an electrically insulating softenable layer on the substrate, the softenable layer comprising migration marking material located at least at or near the surface of the softenable layer spaced from the substrate and a charge transport molecule, (for example the imaging member described in U.S. Pat. No. 4,536,458) is uniformly charged and exposed to activating radiation in an imagewise pattern. The resistance to migration of marking material in the softenable layer is thereafter decreased sufficiently by the application of solvent vapor to allow the light exposed particles to retain a slight net charge which allows only slight agglomeration, coalescence, and/or slight migration in depth of marking material towards the substrate in image configuration, and the resistance to migration of marking material in the softenable layer is further decreased sufficiently by heating to allow nonexposed marking material to substantially agglomerate and coalesce. This development process is essentially dry and involves no material removal or addition to the imaging member. The image sense of the developed images is optically sign-reversed. The aforementioned migration imaging member utilizes metallized polyester film, such as aluminized polyester film, as the substrate. The $D_{min}$ for the developed images is typically in the range of 0.25 to 0.35 and the optical contrast density ($D_{max}$-$D_{min}$) is typically 0.8 to 1.3, depending on whether an overcoating layer is used to overcoat the migration imaging member.

Also, in U.S. Pat. No. 4,536,458, there is illustrated a migration imaging member comprising a substrate and an electrically insulating softenable layer on the substrate, the softenable layer comprising migration marking material located at least at or near the surface of the softenable layer spaced from the substrate and a charge transport molecule. The migration imaging member is electrostatically charged, exposed to activating radiation in an imagewise pattern and developed by decreasing the resistance to migration, by exposure either to solvent vapor or to heat, of marking material in depth in the softenable layer at least sufficient to allow migration of marking material whereby marking material migrates toward the substrate in image configuration. This migration imaging member utilizes, for example, an aluminized polyester film as the substrate. The $D_{min}$ for this imaged member is typically in the range of 0.6 to 0.7 and the optical contrast density ($D_{max}$-$D_{min}$) is typically 0.9 to 1.2.

There are many disadvantages associated with these prior art imaging members. Most notably, many of the aforesaid prior art migration imaging members produce images which exhibit relatively high minimum optical density ($D_{min}$). The relatively high minimum optical density renders the imaging members unsuitable for use in many commercial micrographic equipment such as viewers, printers and duplicators. For example, when the imaged member is projected either onto a screen for the purpose of viewing or onto a photoreceptor for the purpose of printing, a relatively high power projection lamp may be required. An increase of 0.3 in the $D_{min}$ will require doubling of the exposure energy from the projection lamp and consequently greatly increases the amount of heat generated. The large amount of heat generated by high power lamps not only may shorten the service life of the lamp, but even more seriously may cause further softening of the softenable layer resulting in further migration and/or agglomeration of the migration marking material. Thus, the image quality and stability are degraded. Additionally, such uncontrolled and nonuniform heating of the migration imaging member can cause dimensional instability of the imaging member.

To minimize $D_{min}$, many prior art migration imaging members utilize a substrate comprising a very thin layer of metal coating, typically from about 0.005 to about 0.01 micrometer thick aluminum, on transparent polyester films. The aluminum coating is deposited by a vacuum-coating process and its thickness and uniformity must be controlled within very tight tolerance limits in order to assure reproducible and uniform optical density over many thousands of square feet of film resulting in greatly increased manufacturing cost of the imaging members. Additionally, it is known that the optical density of the aluminum coating changes with environmental conditions due to the effects of oxidization. Although other more inert metals such as titanium may be selected, these materials are more expensive and/or require more complex and costly manufacturing processes such as sputtering for deposition. Furthermore, the aluminum coating, being 0.005 to 0.01 micrometer thick, can be easily scratched when subjected to rigorous handling conditions, for example, during manufacture, storage or use resulting in loss of electrical continuity and degraded image qualities. Moreover, to minimize manufacturing cost, it is advantageous to produce the electrically conductive layer and the softenable polymer layer in-line, that is in a single coating operation and preferably on a single apparatus without the need for two separate coating processes, for example, by vacuum coating for the metallic conductive layer and solvent coating for the softenable polymer layer as is required for prior art migration imaging members. Another shortcoming is that metallic coatings, such as aluminum, generally exhibit rather poor adhesion to the polyester films. It is often necessary to subject the surface of the polyester films to special treatment processes such as corona treatment to promote adhesion. This results in an additional increase in manufacturing cost of the imaging members. The aforementioned disadvantages are alleviated with the imaging members of the present invention wherein there is avoided a metal substrate such as aluminum.

Therefore, there continues to be a need for improved migration imaging members and processes. Additionally, there is a need for an improved migration imaging member wherein the disadvantages mentioned herein, including the selection of an uneconomical metal such as an aluminum electrode are avoided. There is also a need for an improved migration imaging member which is capable of producing images having a very low $D_{min}$ close to that of silver-halide images and high contrast density of from about 0.6 to about 1.2 and preferably from about 0.9 to about 1.2, and which exhibits improved interfacial adhesion and greater resistance to the adverse effects of abrasion. Furthermore, there is a need for an improved and less costly migration imaging member in which the conductive electrode and the softenable layer can be produced in a single coating operation and on a single apparatus such as a polymer coater with multiple coating stations. Other embodiments of the present invention and the advantages thereof are illustrated herein.

The expression "softenable" is intended to encompass any material which can be rendered more permeable thereby enabling particles to migrate therethrough. Conventionally, changing the permeability of such material or reducing its resistance to migration of migration marking material is accomplished by dissolving, swelling, melting or softening, by techniques, for example, such as contacting with heat, vapors, partial solvents, solvent vapors, solvents and combinations thereof, or by otherwise reducing the viscosity of the softenable material by any suitable means.

"Fracturable" layer or material refers to any layer or material which is capable of breaking up during development, thereby permitting portions of said layer to migrate toward the substrate or to be otherwise removed. The fracturable layer is preferably particulate. Also, the fracturable layers of marking material are typically contiguous to the surface of the softenable layer spaced apart from the substrate, and such fracturable layers may be substantially or wholly embedded in the softenable layer in various embodiments of the imaging members.

The expression "contiguous" refers to actual contact, touching, also, near, though not in contact, and adjoining, and is intended to generically describe the relationship of the fracturable layer of marking material in the softenable layer, vis-a-vis, the surface of the softenable layer spaced apart from the substrate. "Optically sign-retained" refers to the dark (higher optical density) and light (lower optical density) areas of the visible image formed on the migration imaging member corresponding to the dark and light areas of the image on the original. The expression "optically sign-reversed" refers to the dark areas of the image formed on the migration imaging member that correspond to the light areas of the image on the original and the light areas of the image formed on the migration imaging member correspond to the dark areas of the image on the original. "Optical contrast density" refers to the difference between maximum optical density ($D_{max}$) and minimum optical density ($D_{min}$) of an image. Optical density is measured by diffuse densitometers with a blue Wratten No. 94 filter. The expression "optical density" refers to "transmission optical density" and is represented by the formula:

$$D=\log_{10}[I_o/I]$$

where I is the transmitted light intensity and $I_o$ is the incident light intensity. The value of transmission optical density provided includes the optical density of the substrate unless otherwise specified. For prior art migration imaging members, there is usually utilized a very thin layer of a metal such as aluminum, typically 0.005 to 0.01 micrometer thick, coated on a transparent polyester film as the substrate primarily to mininimize the $D_{min}$ of the imaged member. Also, with these imaging members the transmission optical density of the substrate is typically about 0.2 which is substantially due to the aluminum layer. With the imaging members of the present invention, which utilize in one embodiment an optically transparent electrically conductive polymer coated on a transparent polyester film as the substrate, the transmission optical density of the substrate approaches about zero, thus enabling a substantial reduction, for example, a reduction of 75 percent or more in the residual background optical density of the imaged member.

"Agglomeration" refers to the coming together and adhering of previously substantially separate particles without the loss of identity of the particles. "Coalescence" is defined as the fusing together of such particles into larger units, usually accompanied by a change of shape of the agglomerate towards a shape of lower energy, such as a sphere.

SUMMARY OF THE INVENTION

It is an object of the present invention to provide an improved migration imaging member with many of the above advantages.

It is another object of the present invention to provide an improved migration imaging member wherein the selection of an uneconomical processed aluminum electrode is avoided.

Further, it is another object of the present invention to provide an improved imaging member with a substantially transparent conductive polymer which is capable of producing migration images having a very low $D_{min}$ close to that of conventional silver halide films.

It is another object of the present invention to provide an improved migration imaging member with a substantially transparent conductive polymer with excellent flexibility, acceptable optical transparency and clarity, and improved adhesion while possessing electrical continuity.

Additionally, it is another object of the present invention to provide an improved migration imaging member which not only possesses tolerance to abrasion, minimizes blocking, and possesses good surface release properties, but is also capable of producing excellent optically sign-retaining or sign-reversed, high resolution, visible images with a low $D_{min}$.

It is yet another object of the present invention to provide an improved migration imaging process which enables excellent optically sign-retained, high resolution, visible images having a low $D_{min}$.

It is yet another object of the present invention to provide an improved migration imaging process which produces excellent optically sign-reversed, high resolution, visible images having a very low $D_{min}$ close to that of conventional silver halide films, which usually have a $D_{min}$ of zero.

Moreover, in another object of the present invention there are provided improved migration imaging members with overcoatings such as those illustrated in U.S. Pat. No. 4,496,642, the disclosure of which is totally incorporated herein by reference.

Also, in another object of the present invention there are provided migration imaging members containing optional charge transport components.

These and other objects of the present invention are accomplished by providing an improved migration imaging member. In one embodiment, the imaging member of the present invention is comprised of a supporting substrate, an electrically conductive layer such as a substantially transparent electrically conductive layer adjacent the substrate, the electrically conductive layer comprising an ionically conductive film forming polymer, and an electrically insulating softenable layer adjacent the electrically conductive layer, the softenable layer comprising a fracturable layer of electrically photosensitive migration marking material such as selenium preferably located substantially at or near the surface of the softenable layer spaced from the electrically conductive layer.

In another embodiment of the present invention, there is provided an improved migration imaging member wherein the softenable layer may comprise charge transport materials, the charge transport materials being capable of, for example, (1) increasing charge injection from the electrically photosensitive migration marking material to the electrically insulating softenable layer, and (2) transporting charge to the electrically conductive layer, which materials are usually dissolved or molecularly dispersed in the electrically insulating softenable layer.

There is also provided in accordance with the present invention an imaging member comprised of an ionically conductive film forming polymer and an electrically insulating softenable layer comprising a fracturable layer containing electrically photosensitive migration marking particles; an imaging member comprised of a transparent electrically conductive layer comprised of an ionically conductive film forming polymer and an electrically insulating softenable layer comprising a fracturable layer containing electrically photosensitive migration marking particles; and methods of imaging thereof.

Additionally, in other embodiments of the present invention imaging member, and particularly the softenable layer may be overcoated with a protective overcoating layer. The overcoating layer which minimizes abrasion, and has other functions such as antiblocking may, for example, comprise an adhesive or release material such as polysiloxane or may comprise a plurality (for example, at least two) of layers in which the outer layer comprises an abhesive or release material of, for example, polysiloxane.

The migration imaging member of the present invention can be selected for imaging process which, for example, comprises providing a migration imaging member comprising a substrate, a substantially transparent electrically conductive layer comprised of an ionically conductive film forming polymer, and an electrically insulating softenable layer adjacent the electrically conductive layer, the softenable layer comprising a fracturable layer of electrically photosensitive migration marking material located substantially at or near the surface of the softenable layer spaced from the electrically conductive layer; electrostatically charging the member to deposit a uniform charge thereon; exposing the member to activating radiation in an imagewise pattern prior to substantial decay of the uniform charge whereby the electrically photosensitive migration marking material struck by the activating radiation photogenerates charge carriers; and developing the member by decreasing the resistance to migration of marking material in depth in the softenable layer at least sufficient to allow migration of marking material whereby marking material migrates towards the substrate in image configuration.

Also included within the scope of the present invention is an imaging method comprising providing a migration imaging member comprising a substrate, a substantially transparent electrically conductive layer comprised of an ionically conductive film forming polymer, and an electrically insulating softenable layer, the electrically insulating softenable layer comprising charge transport molecules and a fracturable layer of closely spaced electrically photosensitive migration marking particles located substantially at or near the imaging surface of the electrically insulating layer, the charge transport molecules in the electrically insulating softenable layer being capable of increasing charge injection from the electrically photosensitive migration marking material to the electrically insulating softenable layer; being capable of transporting charge to the substrate and being dissolved or molecularly dispersed in the electrically insulating softenable layer; electrostatically charging the member to deposit a uniform charge thereon; exposing the member to activating radiation in an imagewise pattern prior to substantial decay of the uniform charge whereby the electrically photosensitive migration marking material struck by the activating radiation photogenerates charge carriers; decreasing the resistance to migration of marking material in the softenable layer sufficiently to allow the exposed migration marking material to retain a slight net charge which allows only slight agglomeration, slight coalescence, and/or slight migration in depth of marking material toward said substrate in image configuration during a further decreasing of the resistance to migration of marking material in said softenable layer; and further decreasing the resistance to migration of marking material in the softenable layer sufficiently to allow nonexposed marking material to agglomerate and coalesce substantially.

A specific migration imaging member of the present invention is comprised of a transparent polyester substrate having a thickness of from about 6 to about 200 micrometers or microns; a substantially transparent electrically conductive layer comprising an ionically conductive film forming polymer such as a sulfonated polystyrene ionomer, which layer is, for example, of a thickness offrom about 0.2 to about 4 micrometers; an electrically insulating softenable layer comprised of a film forming polymer such as styrene acrylates, styrene methacrylates, including styrene hexylmethacrylate, electrically photosensitive migration marking material such as selenium or its alloys, including selenium arsenic, selenium tellurium, and the like; halogen doped (from about 200 parts to about 500 parts per million) selenium and selenium alloys, and the like; and an optional charge transport material, including aryl amines, such as N,N'-diphenyl-N,N'-bis(3''-methylphenyl)-(1,1'-biphenyl)-4,4'-diamine, reference U.S. Pat. No. 4,265,990, the disclosure of which is totally incorporated herein by reference, wherein the softenable layer is of a thickness of from about 1 to about 25 micrometers, and an optional overcoating protective layer.

The migration imaging members of the present invention are useful for a variety of imaging applications as indicated herein including information recording and storage, xerography, xeroprinting/duplicating processes, and the like.

BRIEF DESCRIPTION OF THE DRAWINGS

For a better understanding of the present invention, and further features thereof reference is made to the following detailed description of various preferred embodiments wherein.

These Figures merely schematically illustrate the invention and are not intended to indicate relative size and dimensions of actual imaging members or components thereof.

DESCRIPTION OF THE PREFERRED EMBODIMENTS

Figure 1:
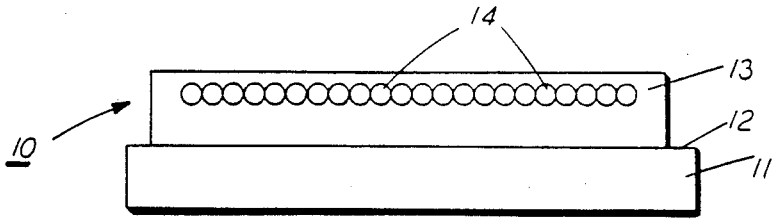
FIG. 1 is a partially schematic, cross-sectional view of a layered migration imaging member of the present invention.
Figure 2:
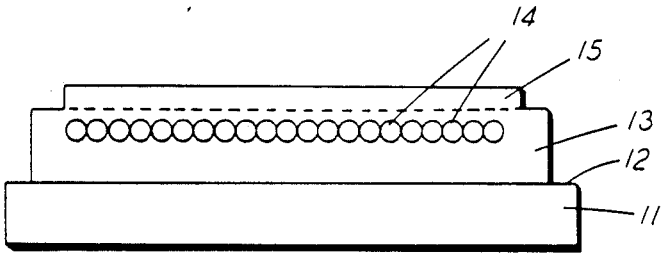
FIG. 2 is a partially schematic, cross-sectional view of an overcoated migration imaging member of the present invention.

Migration imaging members of the present invention and typically suitable for use in the migration imaging processes described herein are illustrated in FIGS. 1 and 2. In FIG. 1, the migration imaging member 10 comprises a substrate 11, a substantially transparent electrically conductive layer 12 comprising an ionically conductive film forming polymer, and a softenable layer 13 coated thereon, softenable layer 13 comprising an optional charge transport material, not shown, and a fracturable layer of migration marking material 14, such as selenium, contiguous with the upper surface of softenable layer 13, the optional charge transport material being dissolved or molecularly dispersed in softenable layer 13. Although the particles of marking material 14 appear to be in contact with each other in FIGS. 1 to 4, the majority of the particles are usually actually spaced less than about 0.1 micrometer apart from each other.

In FIG. 2, a multilayered overcoated member embodiment of the present invention is illustrated wherein the migration imaging member comprises a substrate 11, a substantially transparent electrically conductive polymer layer 12, and a softenable layer 13 coated thereon comprising a fracturable layer of migration marking material 14 and an optional charge transport material, the optional charge transport material being dissolved or molecularly dispersed in softenable layer 13. The migration marking material 14 is initially arranged in a fracturable layer contiguous the upper surface of softenable layer 13. In the embodiment illustrated in FIG. 2, the migration imaging member also includes an overcoating layer 15 on the softenable layer 13. The overcoating layer 15 can be comprised of a single layer or a plurality of layers, at least two layers in some embodiments of the present invention, which overcoatings are comprised of an abhesive or release material. Examples of overcoatings are illustrated in U.S. Pat. No. 4,496,642, the disclosure of which is totally incorporated herein by reference.

The supporting substrate 11 having a thickness of, for example, from about 6 to about 200 micrometers may be either electrically insulating or electrically conductive. The supporting substrate 11 and the entire migration imaging member which it supports may be in any suitable form including a web, foil, laminate or the like, strip, sheet, coil, cylinder, drum, endless belt, endless mobius strip, circular disc or other shape. Typical supporting substrates include polyester, metal plates, drums or the like. Also, the substrate may be transparent, translucent, or opaque. In one preferred embodiment, to enable, for example, a very low $D_{min}$ of 0.05 to about 0.08 for the imaging member it is important that the substrate 11 be transparent. It is generally preferred that a polyester film be selected as the film substrate, however, other transparent materials can be selected including cellulose acetate films, polycarbonate films, polysulfone films, and the like.

The substantially transparent electrically conductive layer 12 is continuous and may, like substrate 11, be of any suitable shape. The electrical conductivity thereof need not be as high as that of a metal conductor such as aluminum. Excellent results have been achieved when the electrical resistivity of the conductive polymer layer 12 is from about $1.0\times10^6$ to about $1.0\times10^9$ ohms per square centimeters (measured at a temperature of 20° C. and a relative humidity of 40 percent).

Any suitable substantially transparent electrically conductive polymer having a thickness, for example, of from about 0.2 to about 4 micrometers may be selected for the imaging members of the present invention. More specifically, as the electrically conductive polymer, which are well known, there may be selected an anionic, electrically conductive resin of sulfonic acid, carboxylic acid or phosphonic acid type and a cationic, electrically conductive polymer having a quaternary ammonium group on the main chain or side chain. Examples of such electrically conductive polymers include:

(1) Electrically conductive resins of the sulfonic acid type, such as polystyrene-sulfonic acid salts, polyvinyltoluene-sulfonic acid salts, and polyvinylsulfonic acid salts;

(2) Electrically conductive resins of the carboxylic acid type, such as polyacrylic acid salts, polymethacrylic acid salts, maleic acid-acrylic acid copolymer salts, maleic acid-vinyl ether copolymer salts, and polyvinylphosphonic acid salts;

(3) Electrically conductive resins of the phosphonic acid type, such as polyvinylphosphonic acid salts;

(4) Polymers having a quaternary ammonium group such as condensates of di-tertiary-amines, polyvinyl trimethyl ammonium chloride, polyallyl trimethyl ammonium chloride, poly(vinylbenzyltrimethyl ammonium chloride), and poly(N-methylpyridinium chloride); and mixtures thereof.

The above group of materials is not intended to be limiting, but merely illustrative of materials suitable for the substantially transparent conductive polymer layer 12.

A particularly preferred electrically conductive polymer is one having the general formula

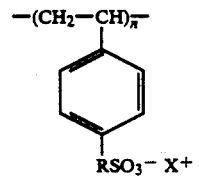

wherein R is an aliphatic or aromatic group, such as alkyl or aryl, including phenyl; X is selected from the group consisting of hydrogen, metals such as sodium, lithium, ammonium, and potassium; and n represents the number of repeating units. Generally, n is a number of from about 10 to about 1,000. These materials are available as, for example, VERSA-TL71, VERSA-TL72, VERSA-TL73, VERSA-TL77, VERSA-TL121, VERSA-TL125, and VERSA-TL126 from National Starch Company.

The substantially transparent electrically conductive layer 12 may be applied to substrate 11 by dissolving the electrically conductive polymer in a suitable solvent and coating the solution by any conventional coating process. Examples of suitable solvents include aliphatic alcohols such as methanol or ethanol, esters such as ethyl acetate, and the like. Typical coating processes include draw bar, spraying, extrusion, dip, gravure roll, wire-wound rod, air knife coating and the like. The thickness of the deposited conductive layer after drying is preferably from about 0.5 to about 4 micrometers although thicker layers may be suitable and desirable in some embodiments providing the objectives of the present invention are achievable.

The softenable material 13 which layer is, for example, of a thickness of from about 1 to about 25 micrometers may be comprised of any suitable material which can be softened by solvent vapors, heat or combinations thereof. In addition, in some embodiments, the softenable material 13 is typically substantially electrically insulating and does not chemically react during the migration force applying and developing steps. Specific examples of softenable materials include styrene-co-n-hexylmethacrylate, styrene ethylacrylate acrylic acid terpolymer, styrene butylmethacrylate, other materials mentioned herein, and the like, reference for example U.S. Pat. No. 4,536,457, the disclosure of which is totally incorporated herein by reference. Generally, any suitable solvent swellable, softenable material may be utilized in the softenable layer, including styrene acrylate copolymers, polystyrenes, alkyd substituted polystyrenes, styrene-olefin copolymers, styrene-co-n-hexylmethacrylate, an 80/20 mole percent copolymer of styrene and hexylmethacrylate having an intrinsic viscosity of 0.179 dl/gm, other copolymers of styrene and hexylmethacrylate, styrene-vinyltoluene copolymer, polyalphamethylstyrene, other styrene methacrylates, styrene acrylates; copolyesters, polyesters, polyurethane, polycarbonate, co-polycarbonates, and mixtures thereof. The above group of materials is not intended to be limiting, but merely illustrative of materials suitable for such softenable layers.

The migration marking material 14 is preferably comprised of an electrically photosensitive, photoconductive, or other suitable materials or mixtures thereof. Typical migration marking materials are illustrated, for example, in U.S. Pat. Nos. 4,536,457; 4,536,458; 3,909,262 and No. 3,975,195, the disclosures of these patents being incorporated herein in their entirety. Specific examples of migration marking materials include selenium and selenium alloys such as selenium-tellurium alloys. The preferred migration marking materials are generally spherical in shape and submicron in size. The migration marking materials should be particulate and closely spaced from each other. These spherical migration marking materials are well known in the migration imaging art. Excellent results are achieved with spherical migration marking materials ranging in size diameter of from about 0.2 micrometer to about 0.4 micrometer, and more preferably from about 0.3 micrometer to about 0.4 micrometer embedded as a subsurface monolayer in the external surface (surface spaced from the substrate if an overcoating is employed) of the softenable layer. The spheres of the migration marking material are preferably spaced from each other by a distance of less than about one-half the diameter of the spheres for maximum optical density and/or to facilitate agglomeration and coalescence of the migration marking material during the heating step. The spheres are also preferably from about 0.01 micrometer to about 0.1 micrometer below the outer surface (surface spaced from the substrate if an overcoating is employed) of the softenable layer. An especially suitable process for depositing the migration marking material in the softenable layer is described in U.S. Pat. No. 4,482,622, the disclosure of which is incorporated herein in its entirety. It is preferred that the migration marking material have a sufficiently low melting point, that is its self-diffusion is rapid at the temperatures used during deposition. The deposition temperatures should not exceed the degradation point of the softenable material, the substrate or any other component of the migration imaging member. The word "rapid" is intended to indicatethat particles of migration marking material which are in contact should coalesce preferably within a fraction of a second or usually within about two minutes.

The overcoating layer 15, reference FIG. 2, for example, with, for example, a thickness of from about 0.1 to about 4 micrometers, and preferably from about 0.5 to about 2.0 micrometers may be substantially electrically insulating, or have any other suitable properties. The overcoating 15 should be substantially transparent at least in the spectral region where electromagnetic radiation is used for the imagewise exposure step in the imaging process. The overcoating layer 15 is continuous and preferably of a thickness of up to about 4 micrometers. Preferably, the overcoating should have a thickness of between about about 0.5 micrometer and about 2 micrometers to minimize residual charge buildup. Overcoating layers greater than about 4 micrometers thick may also be used, however, depending, for example, on the overcoating selected in some instances such thicknesses may cause cycle-up when multiple prints are made if the imaging member is used for xeroprinting because of the tendency of charge trapping to occur in the bulk of the overcoating layer. Typical overcoating materials include acrylic-styrene copolymers, methacrylate polymers, methacrylate copolymers, styrene-butylmethacrylate copolymers, butylmethacrylate resins, vinylchloride copolymers, fluorinated homo or copolymers, high molecular weight polyvinyl acetate, organosilicon polymers and copolymers, polyesters, polycarbonates, polyamides, polyvinyl toluene, and the like as indicated herein for example. The overcoating layer should protect the softenable layer 13 to provide greater resistance to the adverse effects of abrasion prior to, during, and after imaging. Also, the overcoating layer may also have abhesive properties at its outer surface which provide improved resistance to blocking. The abhesive properties may be inherent in the overcoating layer or may be imparted to the overcoating layer by incorporation of another layer or component of abhesive material. These abhesive materials should not degrade the film forming components of the overcoating and should preferably have a surface energy of less than about 20 ergs/cm$^2$. Typical abhesive materials include fatty acids, salts and esters, fluorocarbons, silicones, and the like. The coatings may be applied by any suitable technique such as draw bar, spray, dip, melt, extrusion or gravure coating. It will be appreciated that these overcoating layers protect the migration imaging member from, for example, abrasion and oxidation before imaging, during imaging, after the members have been imaged, and the like.

Various suitable charge transport materials include those which are soluble or dispersible on a molecular scale in the softenable layer material, or such materials may, for example, be comprised of the softenable layer or other polymer providing they transport charge. The charge transport material is comprised of an electrically insulating film-forming binder, a soluble or molecularly dispersible material dissolved, or molecularly dispersed in an electrically insulating film-forming binder which is capable of improving the charge injection process (for at least one sign of charge) from the marking material into the softenable layer (preferably prior to, or at least in the early stages of, development by softening of the softenable layer). The charge transport materials may be hole transport materials and/or electron transport materials, that is, they may improve the injection of holes and/or electrons from the marking material into the softenable layer. Where only one polarity of injection is improved, the sign of ionic charge used to initially sensitize the migration marking member to light for the purposes of this invention is most commonly the same as the sign of charge whose injection is improved. The selection of a combination of a specific transport material with a specific marking material should therefore be such that the injection of holes and/or electrons from the marking material into the softenable layer is improved compared to a softenable layer which is free of any transport material. Where the charge transport material is to be dissolved or molecularly dispersed in an insulating film-forming binder, the combination of the charge transport material and the insulating film-forming binder should be such that the charge transport material may be incorporated into the film-forming binder in sufficient concentration levels while still remaining in solution or molecularly dispersed. If desired, the insulating film-forming binder need not be utilized where the charge transport material is a polymeric film-forming material.

Examples of suitable charge transporting materials include those as illustrated in U.S. Pat. No. 4,536,457, the disclosure of which is totally incorporated herein by reference. Specific examples of charge transporting components are:

1. Diamine transport molecules of the types described in U.S. Pat. Nos. 4,306,008; 4,304,829; 4,233,384; 4,115,116; 4,299,897 and No. 4,081,274, the disclosures of which are totally incorporated herein by reference. Typical specific diamine transport molecules include N,N'-diphenyl-N,N'-bis(3''-methylphenyl)-(1,1'-biphenyl)-4,4'-diamine, N,N'-diphenyl-N,N'-bis(4-methylphenyl)-(1,1'-biphenyl)-4,4'-diamine, N,N'-diphenyl-N,N'-bis(2-methylphenyl)-(1,1'-biphenyl)-4,4'-diamine, N,N'-diphenyl-N,N'-bis(3-ethylphenyl)-(1,1'-biphenyl)-4,4'-diamine, N,N'-diphenyl-N,N'-bis(4-ethylphenyl)-(1,1'-biphenyl)-4,4'-diamine, N,N'-diphenyl-N,N'-bis(4-n-butylphenyl)-(1,1'-biphenyl)-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra-(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl-[2,2'-dimethyl-1,1'-biphenyl]-4,4'-diamine, N,N'-diphenyl-N,N'bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like;

2. pyrazoline transport molecules as disclosed in U.S. Pat. Nos. 4,315,982; 4,278,746 and No. 3,837,851, the disclosures of which are totally incorporated herein by reference. Typical pyrazoline transport molecules include 1-[lepidyl-(2)[-3-(p-diethylaminophenyl)-5-(p-diethylaminophenyl)pyrazoline, 1-[quinolyl-(2)]-3-(p-diethylaminophenyl)-5-(p-diethylaminophenyl)pyrazoline, 1-[pyridyl-(2)]-3-(p-diethylaminostyryl)-5-(p-diethylaminophenyl)pyrazoline, 1-[6-methoxypyridyl-(2)]-3-(p-diethylaminostyryl)-5-(p-diethylaminophenyl)-pyrazoline, 1-phenyl-3-[p-dimethylaminostyryl]-5-(p-dimethylaminostyryl)pyrazoline, 1-phenyl-3-[p-diethylaminostyryl]-5-(p-diethylaminostyryl)pyrazoline, and the like;

3. substituted fluorene charge transport molecules as described in U.S. Pat. No. 4,245,021, the disclosure of which is totally incorporated herein by reference. Typical fluorene charge transport molecules include 9-(4'-dimethylaminobenzylidene)fluorene, 9-(4'-methoxybenzylidene)fluorene, 9-(2',4'-dimethoxybenzylidene)fluorene, 2-nitro-9-benzylidene-fluorene, 2-nitro-9-(4'-diethylaminobenzylidene)fluorene, and the like;

4. oxadiazole transport molecules such as 2,5-bis(4-diethylaminophenyl)-1,3,4-oxadiazole, pyrazoline, imidazole, triazole, and the like. Other typical oxadiazole transport molecules are described, for example, in German Patent Nos. 1,058,836; 1,060,260 and 1,120,875 the disclosures of which are totally incorporated herein by reference;

5. hydrazone transport molecules such as p-diethylamino benzaldehyde-(diphenyl hydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde-(diphenylhydrazone), 1-naphthalenecarbaldehyde 1-methyl-1-phenylhydrazone, 1-naphthalenecarbaldehyde 1,1-phenylhydrazone, 4-methoxynaphthalene-1-carbaldehyde 1-methyl-1-phenylhydrazone, and the like. Other typical hydrazone transport molecules are described, for example, in U.S. Pat. Nos. 4,150,987; 4,385,106; 4,338,388 and No. 4,387,147, the disclosures of which are totally incorporated herein by reference;

6. carbazole phenyl hydrazone transport molecules such as 9-ethylcarbazole-3-carboaldehyde-1-methyl-1-phenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and the like can be also selected. Other typical carbazole phenyl hydrazone transport molecules are described in U.S. Pat. Nos. 4,256,821 and U.S. Pat. No. 4,297,426, the disclosures of which are totally incorporated herein by reference;

7. vinyl aromatic polymers such as polyvinyl anthracene; formaldehyde condensation products with various aromatics such as condensates of formaldehyde and 3-bromopyrene; 2,4,7-trinitrofluorenone, and 3,6-dinitro-N-t-butyl-naphthalimide as described in U.S. Pat. No. 3,972,717, the disclosure of which is totally incorporated herein by reference;

8. oxadiazole derivatives such as 2,5-bis-(p-diethylaminophenyl)oxadiazole-1,3,4 described in U.S. Pat. No. 3,895,944, the disclosure of which is totally incorporated herein by reference;

9. tri-substituted methanes such as alkyl-bis(N,N-dialkylaminoaryl)methane, cycloalkyl-bis(N,N-dialkylaminoaryl)methane, and cycloalkenyl-bis(N,N-dialkylaminoaryl)methane as described in U.S. Pat. No. 3,820,989, the disclosure of which is totally incorporated herein by reference;

10. 9-fluorenylidene methane derivatives having the formula:

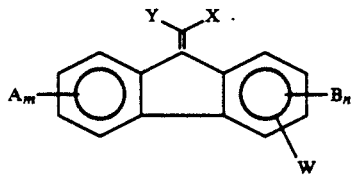

wherein X and Y are cyano groups or alkoxycarbonyl groups; A, B, and W are electron withdrawing groups independently selected from the group consisting of acyl, alkoxycarbonyl, nitro, alkylaminocarbonyl and derivatives thereof; m is a number of from 0 to 2; and n is the number 0 or 1 as described in U.S. Pat. No. 4,474,865, the disclosure of which is totally incorporated herein by reference. Typical 9-fluorenylidene methane derivatives encompassed by the above formula include (4-n-butoxycarbonyl-9-fluorenylidene)-malonontrile, (4-phenethoxycarbonyl-9-fluorenylidene)malonontrile, (4-carbitoxy-9-fluorenylidene)malonontrile, (4-n-butoxycarbonyl-2,7-dinitro-9-fluoroenylidene)malonate, and the like.

Other charge transport materials include poly-1-vinylpyrene, poly-9-vinylanthracene, poly-9-(4-pentenyl)-carbazole, poly-9-(5-hexyl)-carbazole, polymethylene pyrene, poly-1-(pyrenyl)butadiene, polymers such as alkyl, nitro, amino, halogen, and hydroxy substitute polymers such as poly-3-amino carbazole, 1,3-dibromo-poly-N-vinyl carbazole and 3,6-dibromo-poly-N-vinyl carbazole, and numerous other transparent organic polymeric or non-polymeric transport materials as described in U.S. Pat. No. 3,870,516, the disclosure of which is totally incorporated herein by reference, can also be selected.

The disclosures of each of the patents identified above pertaining to charge transport molecules which are soluble or dispersible on a molecular scale in a film forming binder are incorporated herein in their entirety.

When the optional charge transport materials are combined with an insulating binder to form the softenable layer 13, the amount of charge transport material which is used may vary depending upon the particular charge transport material and its compatibility (for example, its solubility) in the continuous insulating film forming binder phase of the softenable layer and the like. Depending on the specific imaging system used, including the specific imaging structure, materials, process steps, and other parameters, satisfactory results may be obtained with between about 0 percent to about 50 percent by weight of charge transport material based on the total weight of the softenable layer. To obtain a $D_{min}$ close to that of conventional silver-halide film, it is preferred that between about 8 percent to about 50 percent by weight of charge transport material based on the total weight of the softenable layer be selected. A particularly preferred charge transport molecule is one having the general formula:

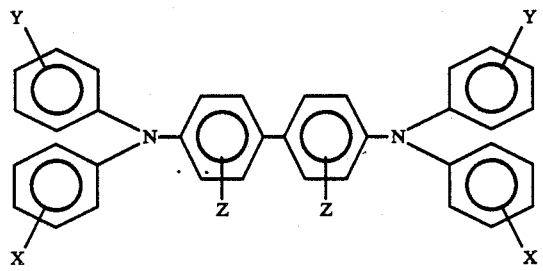

wherein X, Y and Z are selected from the group consisting of hydrogen, an alkyl group having from 1 to about 20 carbon atoms and chlorine, and at least one of X, Y and Z is independently selected to be an alkyl group having from 1 to about 20 carbon atoms or chlorine. If Y and Z are hydrogen, the compound may be named N,N'-bis(alkylphenyl)-[1,1'-biphenyl]-4,4'-diamine wherein the alkyl is, for example, methyl, ethyl, propyl, n-butyl, and the like, or the compound may be N,N'-diphenyl-N,N'-bis(chlorophenyl)-[1,1'-biphenyl]-4,4'-diamine.

When a combination of vapor and heating is used to develop the imaging member, and there is desired excellent a $D_{min}$ close to that of silver-halide images and exceptional storage stability, the softenable layer preferably contains between about 8 percent to about 40 percent by weight of these diamine compounds based on the total weight of the softenable layer. Optimum results are achieved when the softenable layer contains between about 16 percent to about 40 percent by weight of N,N'-diphenyl-N,N'-bis(3''-methylphenyl)-(1,1'-biphenyl)-4,4'-diamine based on the total weight of the softenable layer. In some embodiments of the present invention when the softenable layer contains less than about 8 percent by weight of these diamine compounds based on the total weight of the softenable layer, $D_{min}$ may be noticeably higher and the extent of photodischarge in the $D_{max}$ area may become less because of inefficient charge transport, resulting in reduced electrostatic contrast potential for xeroprinting. Also, in some embodiments of the present invention when the concentration of the charge transport molecule is more than about 50 percent by weight of these diamine compounds based on the total weight of the softenable layer, the mechanical strength, flexibility and integrity of the softenable layer are somewhat degraded and dark charge decay may become higher. Moreover, very large concentrations of these diamine compounds may cause crystallization of the compounds in the softenable layer.

When either vapor only or heat only is selected to develop the imaging member, the imaging results, including the $D_{min}$ value, are usually not affected by the presence or absence of the charge transport material in the softenable layer and excellent results may be achieved when the softenable layer contains between about 0 percent to about 40 percent by weight of these diamine compounds based on the total weight of the softenable layer.

The charge transport material may be incorporated into the softenable layer by any suitable technique. For example, it may be mixed with the softenable layer components by dissolution in a common solvent, such as toluene. If desired, a mixture of solvents for the softenable layer may be used to facilitate mixing and coating.

The charge transport material and softenable layer mixture may be applied to the substrate by any conventional coating process. Typical coating processes include draw bar, spraying, extrusion, dip, gravure roll, wire wound rod, air knife coating, and the like. The thickness of the deposited softenable layer depends on the intended applications of the final image. Where the ultimate objective is solely to create a visible image on the imaging member, the thickness of the softenable layer is generally from about 1 to about 3 micrometers. However, if the imaged member is to be used as a xeroprinting master for xeroprinting, the thickness of the deposited softenable layer after any drying or curing step is preferably from about about 3 to about 25 micrometers thereby, for example, enabling sufficiently high electrostatic contrast potential. Layers thicker than about 25 micrometers may also be utilized.

For migration imaging member development systems utilizing solvent pretreatment followed by heating, other factors should be considered. For these systems, any suitable solvent for the softenable material in the softenable layer may be employed. Upon contact, the solvent should soften the softenable layer sufficiently to allow the exposed migration marking material to retain a slight net charge which allows at most only slight agglomeration/coalescence and/or slight migration in depth of migration marking material towards the substrate in image configuration, and upon further decreasing the resistance to migration of marking material in the softenable layer to allow nonexposed marking material to substantially agglomerate and coalesce. Typical solvents includes various ketones, aliphatic esters, halogenated aliphatics, and mixtures thereof. Softening of the softenable layer sufficiently to allow no more than slight agglomeration, coalescence and/or slight migration in depth of migration marking material towards the substrate in image configuration may be effected by contact with vapors or liquids of solvents or mixtures of solvents. If desired, the mixtures of solvents may comprise a mixture of poor solvents and desirable solvents for the softenable material to control the degree of softening of the softenable material within a given period of time. Typical combinations of softenable materials and solvents or combinations of solvents include styrene ethylacrylate copolymer and methyl ethyl ketone solvent, styrene hexylmethacrylate copolymer and methyl ethyl ketone solvent, styrene hexylmethacrylate copolymer and ethyl acetate solvent, styrene hexylmethacrylate copolymer and diethyl ketone solvent, styrene hexylmethacrylate copolymer and methylene chloride solvent, styrene butylmethacrylate and 1,1,1 trichlorethane solvent, styrene hexylmethacrylate copolymer and mixture of toluene, and isopropanol solvents, styrene butadiene copolymer and mixture of ethyl acetate and butyl acetate solvents. If an optional overcoating layer is used on top of the softenable layer to improve abrasion resistance, the overcoating layer should be permeable to the vapor of the solvent selected and additional vapor treatment time should be allowed so that the solvent vapor can soften the softenable layer sufficiently to allow the exposed migration marking material to retain a slight net charge which allows only slight agglomeration, coalescence, and/or slight migration in depth of migration marking material towards the substrate in image configuration, and upon further decreasing the resistance to migration of marking material in the softenable layer to allow nonexposed marking material to substantially agglomerate and coalesce.

Figure 3A:
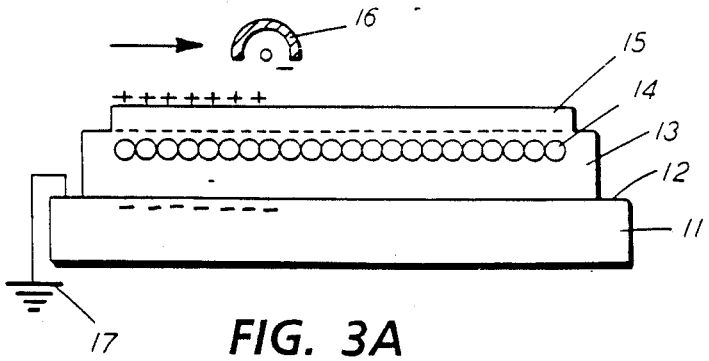
FIGS. 3A, 3B, and 3C are partially schematic, cross-sectional views of the process steps that enable the formation of migration images in one embodiment of the present invention.
Figure 3B:
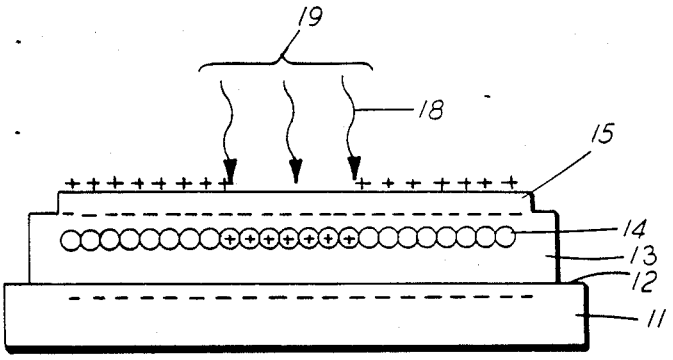
Figure 3C:
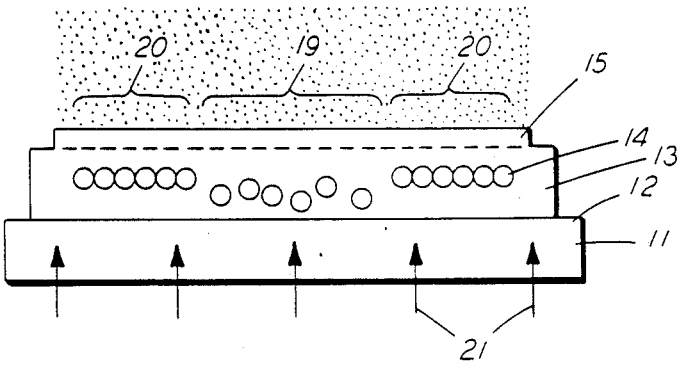

The improved imaging members of the present invention can be selected in the imaging process illustrated, for example, in FIGS. 3A, 3B and 3C, wherein the layers are represented by the same numbers and are thus of the same or similar components as described with respect to FIGS. 1 and 2. The imaging process typically comprises the steps of uniformly electrostatically charging the member, for example, to about 200 volts for an imaging member having a softenable layer of about 2 micrometers, and then exposing the charged member to activating electromagnetic radiation in an imagewise pattern to form an electrical latent image on the imaging member, and developing the latent image by decreasing the resistance of the softenable material, for example, by solvent vapor, heat, or combinations thereof, to allow migration of the particulate marking material through the softenable layer whereby migration marking material is allowed to migrate in depth in softenable material layer in an imagewise configuration as shown in FIGS. 3A, 3B and 3C. The imaging member illustrated in FIGS. 3A, 3B and 3C is a layered configuration of the imaging member like that illustrated in FIG. 2.

In FIGS. 3A, 3B and 3C the numbers 11, 12, 13, 14 and 15 represent the same or similar materials as those represented in FIGS. 1 and 2. The imaging member of FIG. 3A is electrostatically positively charged with a corona charging device 16; the substrate 11 has a substantially transparent conductive coating 12 grounded by 17 or maintained at a predetermined potential during electrostatic charging.

With reference to 3B, the charged imaging member is exposed to activating electromagnetic radiation 18 in area 19, thereby forming an electrical latent image on the imaging member. Generally, satisfactory results may be obtained when the dark decay is less than about 50 percent of the initial charge, and more specifically a dark decay of less than about 25 percent of the initial charge is preferred for optimum charging, see U.S. Pat. No. 4,536,457, the disclosure of which has been totally incorporated herein by reference.

The member having the electrical latent image thereon is then exposed to solvent vapor represented by dots, reference FIG. 3C. The slight net charge on the migration marking particles in the exposed area 19, coupled with the vapor treatment, causes the migration marking particles to migrate slightly away from the softenable surface spaced from the substrate to increase separation between adjacent migration marking particles. Unexposed areas are represented by 20. Similar imaging members are illustrated in FIGS. 4A, 4B, 4C and 4D wherein like numerals represent the same or similar components as illustrated with reference to the above Figures, and 22 represents uncharged migration marking material, which is allowed to agglomerate and substantially to coalesce to form larger particles. For further details with respect to the above mentioned figures, reference is made to U.S. Pat. No. 4,536,457, the disclosure of which has been totally incorporated herein by reference. However, more specific details with respect to the imaging members and methods of imaging with these members are as illustrated herein.

An electrical latent image may be formed on the imaging member by uniformly electrostatically charging the member and then exposing the charged member to activating electromagnetic radiation in an imagewise pattern prior to substantial dark decay of said uniform charge. Satisfactory results are usually obtained if the dark decay is less than about 50 percent of the initial charge, thus the expression "substantial decay" is intended to mean a dark decay of more than 50 percent of the initial charge. A dark decay of less than about 25 percent of the initial charge is preferred for optimum imaging. The charging and exposing steps are illustrated in FIGS. 3A and 3B. In FIG. 3A, the imaging member of the present invention comprising a supporting substrate 11 having a substantially transparent electrically conductive polymer coating 12 thereon, a softenable layer 13, a fracturable layer of marking material 14 contiguous the surface of the softenable layer 13 is shown being electrostatically charged with a corona charging device 16, the substantially transparent electrically conductive polymer coating 12 is grounded as shown at 17 during electrostatic charging. In FIG. 3B, the charged member is shown being exposed to activating electromagnetic radiation 18 in an imagewise pattern thereby forming an electrical latent image upon the imaging member.

The member having the electrical latent image thereon is then developed by decreasing the resistance of the softenable material to allow migration of the particulate marking material through the softenable layer 13 as shown in FIG. 3C by, for example, application of solvent vapor such as toluene radiating into the softenable material 13 to effect softening. The application of solvent vapors, or heat, or combinations thereof, or any other suitable means for decreasing the resistance of the softenable material of softenable layer 13 may be utilized to develop the latent image by allowing migration marking material 14 to migrate in depth in the softenable layer in imagewise configuration. In FIG. 3C, the migration marking material is shown migrated in area 19 (the exposed region) and in its initial, unmigrated state in areas 20 (the unexposed region). The areas 19 and 20 correspond to the formation of the electric latent image described in conjunction with FIGS. 3A and 3B. The migrated, imaged member illustrated in FIG. 3C is shown with the overcoating layer 15 thereon. This overcoating layer 15 protects the imaging member prior to, during, and after imaging. If desired, a nonovercoated imaging member like that illustrated in FIG. 1 may be substituted for the overcoated imaging member illustrated in FIG. 2.

In the development step illustrated in FIG. 3C, the imaging member is developed by uniformly exposing the structure to the vapor of an organic solvent. A preferred solvent utilized for solvent vapor development is toluene with a vapor exposure time of between about 4 seconds and about 60 seconds at a solvent vapor partial pressure of between about 5 millimeters and 30 millimeters of mercury. When the vapor of a solvent is applied, the softenable layer 13 decreases in viscosity thereby decreasing its resistance to migration of the marking material in depth through the softenable layer in the exposed area 19.

If desired, heat development may be substituted for the vapor development step shown in FIG. 3C. Heat development of migration imaging members is well known in the art. The imaging member is typically developed by uniformly heating the structure to a relatively low temperature. For example, at a temperature of 110° C. to about 130° C., heat need only be applied for a few seconds for softenable layers containing a 80/20 styrene hexylmethacrylate copolymer having a melt viscosity of about $10^4$ poise at 115° C. For lower heating temperatures, more heating time may be required.

The imaging members illustrated in FIGS. 1 and 2 may also be imaged by uniform charging, imagewise exposure, uniform exposure to the vapor of a solvent followed by the application of heat as illustrated herein, reference for example FIGS. 4A, 4B, 4C and 4D. When the supporting substrate 11, the substantially transparent electrically conductive polymer layer 12, and the optional overcoating layer 15 are light transmitting, these members, when imaged, may be highly visible light transmitting because of the selective agglomeration and coalescence of the migration marking material in the unexposed region. The vapor must be applied to the imaging member after imagewise exposure and prior to a final heat development step in order to achieve the exceptionally low $D_{min}$ for the imaging member used in the imaging process of this invention.

Figure 4A:
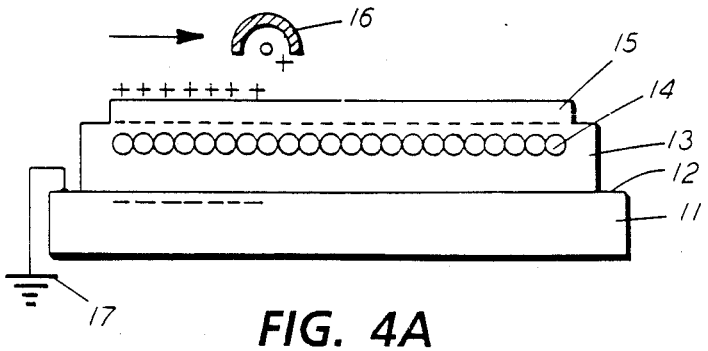
FIGS. 4A, 4B, 4C and 4D are partially schematic, cross-sectional views of the process steps of an imaging process to enable the formation of images in accordance with the present invention.
Figure 4B:
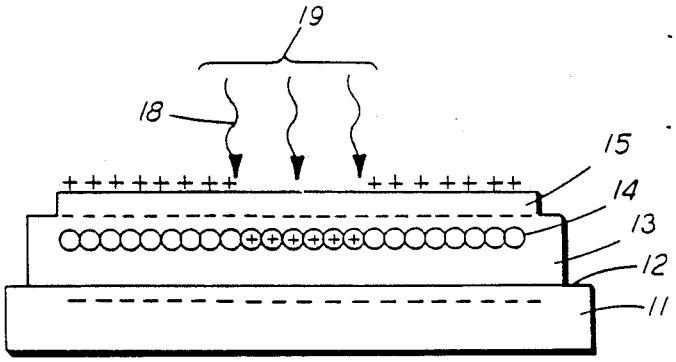

In FIG. 4A, the imaging member comprising a supporting substrate 11 having a substantially transparent electrically conductive polymer layer 12 thereon, softenable layer 13 comprising a fracturable layer of migration marking material 14 contiguous the surface of the softenable layer 13 and charge transport molecules, and an overcoating layer 15 thereon, is shown as being electrostatically positively charged with corona charging device 16, for example, to about 200 volts for an imaging member having a softenable layer thickness of about 2 micrometers. The substantially transparent electrically conductive polymer layer 12 is grounded as shown in 17 during electrostatic charging. In FIG. 4B, the charged member is shown being exposed to activating electromagnetic radiation 18 in area 19 thereby forming an electrostatic latent image upon the member. Exposure in an imagewise pattern to form an electrical latent image upon the migration imaging member should be effected prior to substantial dark decay of the deposited surface charge. Satisfactory results may be obtained if the dark decay is less than about 50 percent of the initial charge. Thus, the expression "prior to substantial decay" is intended to mean the dark decay is less than 50 percent of the initial charge. A dark decay of less than about 25 percent of the initial charge is preferred for optimum imaging of the migration imaging member.

Figure 4C:
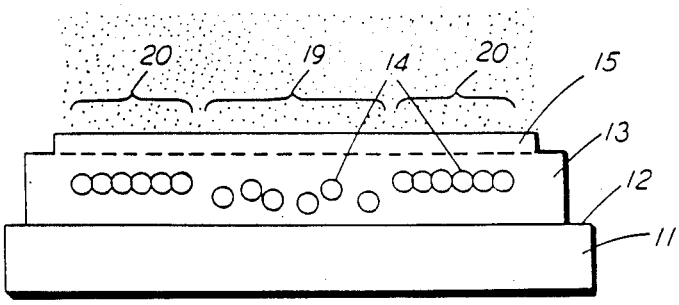

The imaging member having the electrical latent image thereon is then exposed to solvent vapor (represented by dots) as shown in FIG. 4C. The vapor exposure time depends upon factors such as the solubility of softenable layer in the solvent, the type of solvent vapor, the ambient temperature and the concentration of the solvent vapors. Moreover, the presence or absence of an overcoating on the softenable layer can affect the exposure time. The charge transport molecule in the softenable layer and the vapor treatment work by limiting the photogenerated charge on the exposed migration marking particles to a reproducible but very small level after the vapor treatment step. This small level of net charge allows only slight agglomeration, coalescence or combination thereof of the exposed migration marking particles during the subsequent heating step. Further, this small level of net charge may cause the light exposed particles to migrate slightly away from the softenable surface spaced from the substrate, slightly increasing the separation between adjacent migration marking particles. This results in a $D_{max}$ region, reference area 19 of FIG. 4C for example. In the unexposed region, the surface charge becomes entirely discharged by vapor exposure.

Figure 4D:
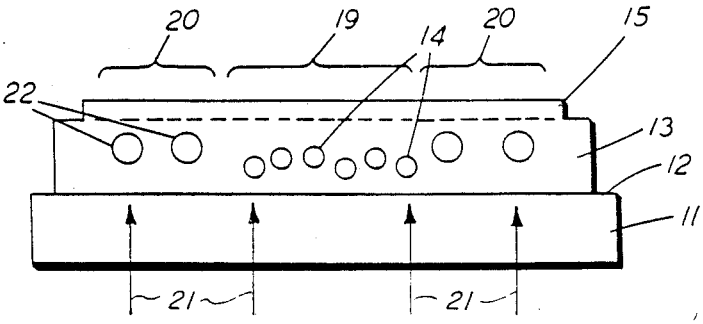

In FIG. 4D, the latent image is further developed by decreasing the resistance of the softenable material to migration of the particulate marking material by application of heat radiating into the softenable material 13 to effect softening. However, the viscosity of the softenable material is substantially reduced by the combined effects of vapor and heat softening that these unexposed particles, which have no residual charge to repel one another and also are still very close to each other, can diffuse randomly into intimate contact with one another, and actually coalesce very rapidly to form very few, much larger spheres 22. These agglomerated/coalesced particles are widely separated and are substantially larger than the wavelengths of visible light that they become essentially invisible, resulting in very low, for example, 0.05 $D_{min}$. As indicated herein the light exposed particles are still slightly charged and/or migrated slightly due to the previous solvent vapor treatment, thus only slight agglomeration/coalescence and/or slight migration occur. The position of these light exposed particles remains substantially unchanged from the position taken during the vapor treatment step shown in FIG. 4C. Thus, in FIG. 4D, the migration marking material is shown slightly agglomerated/coalesced and/or migrated in the exposed region and in a substantially agglomerated/coalesced state in the unexposed region. The exposed and unexposed regions correspond to the formation of the electrical latent image described in conjunction with FIGS. 4A and 4B. Thus, the imaging process produces optically negative images from positive originals or optically positive images from negative originals, for example, optically sign-reversed images if light-lens systems are used for imagewise exposure. Imagewise exposure may be effected by means other than light-lens systems, for example, Raster Output Scanning devices such as laser writers. Satisfactory results have been achieved with vapor exposure times of between about 10 seconds and about 2 minutes at 21° C. and development heating temperatures between about 80° C. and about 120° C. for 2 seconds to 2 minutes (the longer times being used with the lower temperatures) and with solvent vapor partial pressures of between about 20 millimeters of mercury and about 80 millimeters of mercury when the solvent is methyl ethyl ketone and the uncoated softenable layer contains a custom synthesized 80/20 mole percent copolymer of styrene and hexylmethacrylate having an intrinsic viscosity of 0.179 dl/gram and N,N'-diphenyl-N,N'-bis(3''-methylphenyl)-(1,1'-biphenyl)-4,4'-diamine. The test for a satisfactory combination of time, temperature and vapor concentration is maximized optical contrast density.

The imaged member illustrated in FIG. 4D is highly transmitting to visible light in the unexposed region because of the substantial agglomeration and coalescence of the migration marking material in the unexposed region. The $D_{min}$ obtained in the unexposed region is almost as low as the optical density of transparent substrates underlying the softenable layer. The $D_{max}$ in the exposed region is high because only slight agglomeration/coalescence and/or slight migration of the light-exposed particles occur. Thus, optically sign-reversed images with high contrast density in the region of 1.0 to 1.3 may be achieved for the imaged member. In addition, exceptional resolution such as 228 line pairs per millimeter may be achieved on the imaged member. The vapor must be applied to the master after the imagewise exposure step but prior to a final heat development step in order to achieve these highly light transmitting images.

In the vapor-heat development, sign-reversing imaging process of this invention, it is believed that in order to achieve the optimum results of this invention most (between 50 and 95 percent, and preferably between 90 and 95 percent) of the photogenerated charge carriers of the same sign as the initially applied ionic charge can usually be injected out of the light exposed migration imaging particles (prior to or in the early stages of development by softening of the softenable layer). After loss (prior to or in the early stages of development) of the other sign of photogenerated charge (by injection out of the particles or by neutralization by the charge initially applied to the surface) only a small net charge is left in the light exposed migration imaging particles. Charge injection of the first sign of charge is accomplished by the incorporation of charge transport materials into the softenable layer of the imaging member. Because of a very small amount of net charge in the light exposed regions, only slight agglomeration/coalescence and/or slight migration of the light-exposed particles occurs. Thus, the optical density is only slightly reduced, for example, to about 1.0 to 1.7 (preferably 1.2 to 1.7 or more, and more preferably 1.4 to 1.7 or more) compared with an initial value of about 1.8 to 1.9. Slight net charge in the particles and/or slight migration is usually necessary to achieve many of the results and advantages of the present invention, however, they should not be excessive since, for example, the $D_{max}$ (and consequently the contrast density) of the final sign-reversed image can be degraded beyond the values illustrated herein. With conventional migration, imaging members free of any charge transport material in the softenable layer, the exposed migration imaging particles gain an appreciable net charge and migrate considerably to produce a low optical density region instead of a high optical density region when processed with the vapor treatment heat development steps for the imaging process of this invention.

Furthermore, in the vapor-heat development, sign-reversing imaging process of the present invention, the unexposed particles do not become charged and do not migrate upon vapor exposure during the vapor treatment step (or during any heat treatment step that might be employed prior to the vapor treatment step), but remain substantially uncharged in the monolayer configuration to allow substantial agglomeration and coalescence during the final heating step which follows the vapor treatment step. With conventional migration imaging members free of any charge transport material in the softenable layer, unexposed particles also generally remain substantially uncharged. Thus, the charge transport materials in the imaging member of this invention primarily alter the electrostatics of the light exposed particles.

The invention will now be described in detail with respect to specific preferred embodiments thereof, it being noted that these examples are intended to be illustrative only and are not intended to limit the scope of the present invention. Parts and percentages are by weight unless otherwise indicated. Examples I to III represent comparative examples wherein there is selected an aluminized polyester substrate and are intended to provide comparative information with respect to the imaging members of the present invention, reference beginning with working Example IV.

EXAMPLE I

A migration imaging member similar to that illustrated in FIG. 1 was prepared by dissolving about 15.0 percent by weight of a 80/20 mole percent of a copolymer of styrene and hexylmethacrylate (softenable layer) in about 85 percent by weight toluene based on the total weight of the solution. The resulting solution was applied by means of a No. 10 wire wound rod to a substrate 12 inches wide, 76 micrometers (3 mil) thick aluminized polyester film (Melinex, type 442 available from ICI). The optical density of the aluminized polyester film as determined by a diffuse sensitometer (Macbeth TR927) with a blue Wratten No. 94 filter was about 0.20 and the thickness of the aluminum layer was about 0.01 micrometer. The deposited softenable layer of styrene and hexylmethacrylate was allowed to dry at about 110° C. for about 15 minutes to a thickness of about 2 micrometers. The temperature of the softenable layer was raised to about 115° C. to lower the viscosity of the exposed surface of the softenable layer to about $5\times10^3$ poises in preparation for the deposition of marking material comprised of vitreous selenium particles. Particulate vitreous selenium was then applied by vacuum deposition in a vacuum chamber maintained at a vacuum of about $4\times10^{-4}$ Torr. The resulting imaging member was then rapidly chilled to room temperature. A reddish monolayer of selenium particles having an average diameter of about 0.3 micrometer embedded about 0.05 to 0.1 micrometer below the exposed surface of the copolymer softenable layer was formed. The resulting imaging member had a very uniform optical density of about 1.85 with no signs of microcrystals or aggregates.

The resulting migration imaging member was thereafter imaged and developed by vapor processing techniques comprising the steps of positive corotron charging to a surface potential of about +200 volts, imagewise exposing with 400 nanometer light of about 2 ergs/cm$^2$, and developing with toluene vapor by immersing the member for 7 seconds in vapor above a liquid bath in an enclosed chamber equipped with a sliding door and fan. The resulting imaged migration imaging member exhibited an optically sign-retained image of the original, excellent image quality, resolution in excess of 228 line pairs per millimeter, and a contrast density of about 1.15. $D_{max}$ as determined by a diffuse sensitometer (Macbeth TR927) with a blue Wratten No. 94 filter was about 1.85 and the $D_{min}$ was about 0.7. The $D_{max}$ area was caused by the unmigrated subsurface selenium particles and the $D_{min}$ area was caused by migrated selenium particles dispersed in the polymer matrix.

EXAMPLE II

A migration imaging member similar to that illustrated in FIG. 1 was prepared by dissolving about 15.0 percent by weight of a 80/20 mole percent copolymer of styrene and hexylmethacrylate, and about 4.8 percent by weight of the hole transport N,N'-diphenyl-N,N'-bis(3''-methylphenyl)-(1,1'-biphenyl)-4,4'-diamine in about 80.2 percent by weight toluene based on the total weight of the solution. The resulting solution was applied by means of a No. 10 wire wound rod to a 12 inch wide 76 micrometers (3 mils) thick aluminized polyester film (Melinex, type 442 available from ICI). The optical density of the aluminized polyester film was about 0.20 and the thickness of the aluminum layer was about 0.01 micrometer. The deposited softenable layer comprised of styrene and hexylmethacrylate doped with N,N'-diphenyl-N,N'-bis(3''-methylphenyl)-(1,1'-biphenyl)-4,4'-diamine was allowed to dry at about 110° C. for about 15 minutes to a thickness of about 2 microns. The temperature of the softenable layer was raised to about 115° C. to lower the viscosity of the exposed surface thereof to about $5\times10^3$ poises in preparation for the deposition of marking material. Particulate vitreous selenium was then applied to the softenable layer by vacuum deposition in a vacuum chamber maintained at a vacuum of about $4\times10^{-4}$ Torr. The resulting imaging member was then rapidly chilled to room temperature. A reddish monolayer of selenium particles having an average diameter of about 0.3 micrometer embedded about 0.05 to 0.1 micrometer below the exposed surface of the copolymer was formed. The resulting imaging member had a very uniform optical density of about 1.85 across the entire area of the film with no signs of microcrystals or aggregates.

The above prepared migration imaging member was thereafter imaged and developed by a combination of vapor and heat processing techniques comprising the steps of positive corotron charging to a surface potential of about +200 volts, imagewise exposing with 400 nanometer light of about 3 ergs/cm$^2$, exposure to methyl ethyl ketone in a vapor chamber for about 15 seconds and heating to about 115° C. for about 5 seconds on a hot plate in contact with the polyester. The resulting imaged migration imaging member exhibited an optically sign-reversed image of the original, excellent image quality, resolution in excess of 228 line pairs per millimeter, and a contrast density of about 0.77. $D_{max}$ was about 1.07 and the $D_{min}$ was about 0.30. The $D_{min}$ area was caused by agglomeration and coalescence of the selenium particles into fewer and larger particles in the $D_{min}$ regions of the image.

EXAMPLE III

The imaging member as prepared in Example II was overcoated with a water solution containing about 10 percent by weight of styreneacrylic copolymer (Neocryl A-622, available from Polyvinyl Chemical Industries) and about 0.03 percent by weight of polysiloxane resin (Byk 301, available from Byk-Mallinckodt). The dried overcoat had a thickness of about 1.5 micrometers.

The resulting overcoated migration imaging member was thereafter imaged and developed by a combination of vapor and heat processing techniques comprising the steps of positive corotron charging to a surface potential of about +280 volts, imagewise exposing with 400 nanometer light of about 3 ergs/cm$^2$, exposure to methyl ethyl ketone in a vapor chamber for about 35 seconds and heating to about 115° C. for about 5 seconds on a hot plate in contact with the polyester. The resulting imaged migration imaging member exhibited an optically sign-reversed image of the original, excellent image quality, resolution in excess of 228 line pairs per millimeter, and a contrast density of about 1.2. $D_{max}$ was about 1.48 and the $D_{min}$ was about 0.28. It was also found from transmission electron microscopy that the $D_{min}$ area was caused by agglomeration and coalescence of the selenium particles into fewer and larger particles in the $D_{min}$ regions of the image.

EXAMPLE IV

A migration imaging member as illustrated in FIG. 1 was prepared using materials and conditions as described in Example I except that the aluminum layer of the aluminized polyester was replaced by a 1.0 micrometer thick, substantially transparent electrically conductive polymer comprised of a polystyrene sulfonic acid. This substantially transparent electrically conductive polymer layer was prepared by dissolving about 10.0 percent by weight of a polystyrene sulfonic acid resin (Versa-TL-72, available from National Starch Company) in about 90 percent by weight ethanol based on the total weight of the solution. The resulting solution was applied by means of a No. 10 wire wound rod to the polyester substrate and dried at 80° C. for about 15 minutes to yield a thickness of about 1.0 micrometer. The electrical conductivity of the conductive layer was about $5\times10^6$ ohms per square centimeter. The resulting imaging member had a very uniform optical density of about 1.65.

The resulting migration imaging member was thereafter imaged by positive corotron charging to a surface potential of about +205 volts, imagewise exposed to activating radiation through a step wedge, and exposed to toluene in a vapor chamber for about 10 seconds. The resulting imaged migration imaging member exhibited an optically sign-retained image of the original, excellent image quality, resolution of 228 line pairs per millimeter, and a contrast density of about 1.2. The $D_{max}$ was about 1.65 and the $D_{min}$ was about 0.45. The $D_{max}$ area results from the unmigrated subsurface selenium particles and the $D_{min}$ area results from the migrated selenium particles dispersed in the polymer matrix.

EXAMPLE V

A migration imaging member similar to that illustrated in FIG. 1 was prepared with materials and conditions as described in Example II except that the aluminum layer of the aluminized polyester was replaced by a 0.8 micrometer thick, substantially transparent electrically conductive polymer comprised of a polystyrene sulfonate sodium salt. This substantially transparent electrically conductive polymer layer was prepared by dissolving about 10.0 percent by weight of a polystyrene sulfonic salt (i.e. VERSA-TL77, available from National Starch Company) in about 90 percent by weight ethonal based on the total weight of the solution. The resulting solution was applied by means of a No. 10 wire wound rod to the polyester substrate and dried at 80° C. for about 15 minutes to yield a dried thickness of about 0.8 micrometer. The electrical conductivity of the conductive layer was about $2\times10^7$ ohms per square centimeter. The resulting imaging member had a very uniform optical density of about 1.65.

The above prepared migration imaging member was thereafter imaged and developed by a combination of vapor and heat processing techniques comprising the steps of positive corotron charging to a surface potential of about +215 volts, imagewise exposing with 400 nanometer light of about 3 ergs/cm$^2$, exposure to methyl ethyl ketone in a vapor chamber for about 35 seconds and heating to about 115° C. for about 5 seconds on a hot plate in contact with the polyester. The resulting imaged migration imaging member exhibited an optically sign-reversed image of the original, excellent image quality, resolution of 228 line pairs per millimeter, and a contrast density of about 0.98. The $D_{max}$ was about 1.03 and the $D_{min}$ was about 0.05. The $D_{min}$ area was caused by agglomeration and coalescence of the selenium particles into fewer and larger particles in the $D_{min}$ regions of the image.

EXAMPLE VI

An imaging member was prepared as described in Example V and overcoated with a water-borne solution containing about 10 percent by weight of styrene-acrylic copolymer (Neocryl A-622, available from Polyvinyl Chemical Industries) and about 0.03 percent by weight of polysiloxane resin (Byk 301, available from Byk-Mallinckodt). The dried overcoat had a thickness of about 1.5 micrometers.

The above prepared overcoated migration imaging member was thereafter imaged and developed by a combination of vapor and heat processing techniques comprising the steps of positive corotron charging to a surface potential of about +310 volts, imagewise exposing with 400 nanometer light of about 3 ergs/cm$^2$, exposure to methyl ethyl ketone in a vapor chamber for about 35 seconds and heating to about 115° C. for about 5 seconds on a hot plate in contact with the polyester. The resulting imaged migration imaging member exhibited an optically sign-reversed image of the original, excellent image quality, resolution of 228 line pairs per millimeter, and a contrast density of about 1.2. The $D_{max}$ was about 1.28 and the $D_{min}$ was about 0.08. The $D_{min}$ area was due to agglomeration and coalescence of the selenium particles into fewer and larger particles in the $D_{min}$ regions of the image. The overcoated migration imaging member exhibited excellent abrasion resistance when scraped with a fingernail. The overcoated member also retained its integrity when subjected to an adhesive-tape test, that is the overcoating was not removed from the imaging member with adhesive tape.

EXAMPLE VII

A migration imaging member similar to that illustrated in FIG. 1 was prepared by dissolving about 15.0 percent by weight of an 80/20 mole percent copolymer of styrene and hexylmethacrylate, and about 4.8 percent by weight of the hole transport N,N'-diphenyl-N,N'-bis(3''-methylphenyl)-(1,1'-biphenyl)-4,4'-diamine in about 80.2 percent by weight toluene based on the total weight of the solution. The resulting solution was applied by means of a No. 10 wire wound rod to a 12 inch wide 76 micrometers (3 mils) thick polyester film (Melinex, type 442 available from ICI) having a 0.5 micrometer thick, substantially transparent electrically conductive polymer comprised of the polystyrene sulfonate obtained from Transcopy, Inc. The deposited softenable layer comprised of styrene and hexylmethacrylate doped with N,N'-diphenyl-N,N'-bis(3''-methylphenyl)-(1,1'-biphenyl)-4,4'-diamine was allowed to dry at about 110° C. for about 15 minutes. The thickness of the dried softenable layer was about 2 micrometers. The temperature of the softenable layer was raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A reddish monolayer of selenium particles having an average diameter of about 0.3 micrometer embedded about 0.05 to 0.1 micrometer below the exposed surface of the copolymer was formed. The resulting imaging members had a very uniform optical density of about 1.65 with no signs of microcrystals or aggregates.

The resulting imaging member was overcoated with a water-borne solution containing about 10 percent by weight of styreneacrylic copolymer (Neocryl A-622, available from Polyvinyl Chemical Industries) and about 0.03 percent by weight of polysiloxane resin (Byk 301, available from Byk-Mallinckodt). The dried overcoat had a thickness of about 1.5 micrometers.

The above prepared overcoated migration imaging member was thereafter imaged and developed by a combination of vapor and heat processing techniques comprising the steps of positive corotron charging to a surface potential of about +310 volts, imagewise exposing with 400 nanometer light of about 3 ergs/cm$^2$, exposure to methyl ethyl ketone in a vapor chamber for about 35 seconds and heating to about 115° C. for about 5 seconds on a hot plate in contact with the polyester. The imaged migration imaging member exhibited an optically sign-reversed image of the original, excellent image quality, resolution in excess of 228 line pairs per millimeter, and a contrast density of about 1.23. The $D_{max}$ was about 1.29 and the $D_{min}$ was about 0.06. The $D_{min}$ area was due to agglomeration and coalescence of the selenium particles into fewer and larger particles in the $D_{min}$ regions of the image. The overcoated migration imaging member exhibited excellent abrasion resistance when scraped with a fingernail. The overcoated member also retained its integrity when subjected to the adhesive tape test as illustrated herein.

EXAMPLE VIII

An imaging member similar to that illustrated in FIG. 1 was prepared by dissolving about 15.0 percent by weight of a 80/20 mole percent copolymer of styrene and butylmethacrylate, and about 4.8 percent by weight of the hole, or charge transport N,N'-diphenyl-N,N'-bis(3''-methylphenyl)-(1,1'-biphenyl)-4,4'-diamine in about 80.2 percent by weight toluene based on the total weight of the solution. The resulting solution was applied by means of a No. 10 wire wound rod to a 12 inch wide 76 micrometers (3 mils) thick polyester film (Melinex, type 442 available from ICI) having a 0.5 micrometer thick, substantially transparent electrically conductive polymer comprised of a polystyrene sulfonate lithium salt (VERSA-TL73 available from National Starch Company). The deposited softenable layer comprised of styrene and butylmethacrylate copolymer doped with N,N'-diphenyl-N,N'-bis(3''-methylphenyl)-(1,1'-biphenyl)-4,4'-diamine was allowed to dry at about 110° C. for about 15 minutes. The thickness of the dried softenable layer was about 2 micrometers. The temperature of the softenable layer was raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A reddish monolayer of selenium particles having an average diameter of about 0.3 micrometer embedded about 0.05 to 0.1 micrometer below the exposed surface of the copolymer was formed. The resulting imaging members had a very uniform optical density of about 1.65.

The above prepared imaging member was overcoated with a water-borne solution containing about 10 percent by weight of styreneacrylic copolymer (Neocryl A-622, available from Polyvinyl Chemical Industries) and about 0.03 percent by weight of polysiloxane resin (Byk 301, available from Byk-Mallinckodt). The dried overcoat had a thickness of about 1.5 micrometers.

The resulting overcoated migration imaging member was thereafter imaged and developed by a combination of vapor and heat processing techniques comprising the steps of positive corotron charging to a surface potential of about +290 volts, imagewise exposing with 400 nanometer light of about 3 ergs/cm$^2$, exposure to methyl ethyl ketone in a vapor chamber for about 35 seconds and heating to about 115° C. for about 5 seconds on a hot plate in contact with the polyester. The resulting imaged migration imaging member exhibited an optically sign-reversed image of the original, excellent image quality, resolution in excess of 228 line pairs per millimeter, and a contrast density of about 1.15. The $D_{max}$ was about 1.23 and the $D_{min}$ was about 0.08. The $D_{min}$ area was due to agglomeration and coalescence of the selenium particles into fewer and larger particles in the $D_{min}$ regions of the image.

Other modifications of the present invention will occur to those skilled in the art based upon a reading of the present disclosure. Thus, for example, a second charging step to reduce the surface voltage down to near zero may be utilized prior to the vapor exposure step. This second charging step is of an opposite polarity to the first. These and other modifications are intended to be included within the scope of the following claims.

What is claimed is:

1. An imaging member comprised of an ionically conductive film forming polymer and an electrically insulating softenable layer comprising a fracturable layer containing electrically photosensitive migration marking particles.

2. An imaging member comprised of a transparent electrically conductive layer comprised of an ionically conductive film forming polymer and an electrically insulating softenable layer comprising a fracturable layer containing electrically photosensitive migration marking particles.

3. An imaging member comprising a supporting substrate, an ionically conductive film forming polymer adjacent said substrate, and an electrically insulating softenable layer, said softenable layer comprising a fracturable layer of electrically photosensitive migration marking particles.

4. An imaging member comprising a substrate, a substantially transparent electrically conductive layer comprised of an ionically conductive film forming polymer adjacent said substrate, and an electrically insulating softenable layer on said substantially transparent electrically conductive layer, said softenable layer comprising a fracturable layer of closely spaced electrically photosensitive migration marking particles located substantially at or near the surface of said softenable layer spaced from said substantially transparent electrically conductive layer.

5. An imaging member in accordance with claim 4 wherein the ionically conductive film forming polymer is a sulfonated polystyrene.

6. An imaging member in accordance with claim 5 wherein the sulfonated polystyrene is VERSA-TL-71, 72, 73, 77, 121, 125, or 126.

7. An imaging member in accordance with claim 6 wherein the sulfonated polystyrene is of the formula

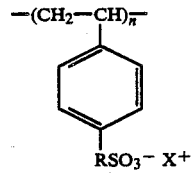

wherein R is an aliphatic or aromatic group, X is an anion, and n represents the number of monomer units.

8. An imaging member in accordance with claim 1 wherein the ionically conductive film forming polymer is a sulfonated polystyrene.

9. An imaging member in accordance with claim 8 wherein the sulfonated polystyrene is VERSA-TL-71, 72, 73, 77, 121, 125, or 126.

10. An imaging member in accordance with claim 8 wherein the sulfonated polystyrene is of the formula

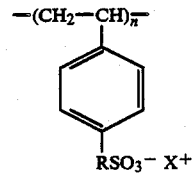

wherein R is an aliphatic or aromatic group, X is an anion, and n represents the number of monomer units.

11. An imaging member in accordance with claim 1 wherein said softenable layer comprises charge transport molecules, which charge transport molecules are capable of increasing charge injection from said electrically photosensitive migration marking material to said softenable layer of transporting charge to said substrate, and are dissolved or molecularly dispersed in said softenable layer.

12. A migration imaging member according to claim 11 wherein said softenable layer comprises about 8 percent to about 50 percent by weight of said charge transport molecule based on the total weight of said softenable layer.

13. A migration imaging member according to claim 12 wherein said charge transport molecules comprise a substituted, unsymmetrical tertiary amine.

14. A migration imaging member according to claim 1 wherein said softenable layer is coated with a protective overcoating comprising a film forming resin.

15. An imaging method comprising providing a migration imaging member comprising a substrate, a substantially transparent electrically conductive polymer layer thereon, and an electrically insulating softenable layer adjacent said electrically conductive polymer layer, said softenable layer comprising a fracturable layer of electrically photosensitive migration marking material located substantially at or near the surface of said softenable layer spaced from said substrate; electrostatically charging said member to deposit a uniform charge on said member; exposing said member to activating radiation in an imagewise pattern prior to substantial decay of said uniform charge; and developing said member by decreasing the resistance to migration of marking material in depth in said softenable layer at least sufficient to allow migration of marking material whereby marking material migrates toward said substrate in image configuration.

16. An imaging method according to claim 15 including decreasing said resistance to migration of marking material in depth in said softenable layer by solvent vapor softening said softenable layer.

17. An imaging method comprising providing a substrate, a substantially transparent electrically conductive polymer layer thereon, and an electrically insulating softenable layer on said substrate, said softenable layer comprising charge transport molecules, said charge transport molecules being capable of increasing charge injection from said electrically photosensitive migration marking material to said softenable layer, being capable of transporting charge to said substrate and being dissolved or molecularly dispersed in said softenable layer, and a fracturable layer of electrically photosensitive migration marking material located substantially at or near the surface of said softenable layer spaced from said electrically conductive polymer layer; exposing said member to activating radiation in an imagewise pattern whereby said electrically photosensitive migration marking material struck by said activating radiation photogenerates charge carriers; decreasing the resistance to migration of migration marking material in said softenable layer sufficiently to allow the light-struck migration marking material to retain a small net charge which allows at most slight agglomeration, slight coalescence, slight migration in depth of marking material towards said substrate or combination thereof; and further decreasing the resistance to migration of marking material in said softenable layer sufficiently to allow migration marking material which escapes radiation to substantially agglomerate and coalesce.

18. An imaging method for preparing an imaging member in accordance with claim 17 wherein said migration of said migration marking material begins in areas of said softenable layer corresponding to said imagewise pattern, which are struck by said activating radiation when the resistance to migration of marking material in said softenable layer sufficiently decreased to allow said migration marking material struck by said activating radiation to retain a slight net charge which allows only slight agglomeration, slight coalescence, slight migration in depth of marking material towards said substrate or combination thereof in image configuration during a further decreasing of the resistance to migration of marking material in said softenable layer thereby forming $D_{max}$ areas in areas of said softenable layer corresponding to said imagewise pattern, which are struck by said activating radiation.

19. An imaging method for preparing an imaging member in accordance with claim 17 including exposing said member to sufficient vapor of a solvent for said softenable layer to allow said migration marking material struck by said activating radiation to retain a slight net charge which allows only slight agglomeration, slight coalescence, slight migration in depth of marking material towards said substrate or combination thereof in image configuration during a further decreasing of the resistance to migration of marking material in said softenable layer in areas of said softenable layer corresponding to said imagewise pattern.

20. An imaging method for preparing an imaging member in accordance with claim 17 wherein said substantial agglomeration and coalescence of said migration marking material in areas of said softenable layer corresponding to said imagewise pattern, which escaped exposure to said activating radiation, begins during said further decreasing the resistance to migration of migration marking material in said softenable layer thereby forming $D_{min}$ areas in areas of said softenable layer corresponding to said imagewise pattern, which escaped exposure to said activating radiation.

21. An imaging method for preparing an imaging member in accordance with claim 17 wherein said further decreasing the resistance to migration of migration marking material in said softenable layer comprises heat softening said softenable layer to begin said substantial agglomeration and coalescence of said migration marking material in areas of said softenable layer corresponding to said imagewise pattern which escaped exposure to said activating radiation.

22. An imaging method for preparing an imaging member in accordance with claim 17 wherein said softenable layer comprises between about 8 percent to about 50 percent by weight of said charge transport molecule based on the total weight of said softenable layer.

23. An imaging member in accordance with claim 1 wherein said fracturable layer is a monolayer.

24. An imaging member in accordance with claim 1 wherein the transparent conductive layer is of a thickness of from about 0.2 to about 4 micrometers.

25. An imaging member in accordance with claim 2 wherein the transparent conductive layer is of a thickness of from about 0.2 to about 4 micrometers.

26. An imaging member in accordance with claim 3 wherein the transparent conductive layer is of a thickness of from about 0.2 to about 4 micrometers.

27. An imaging member in accordance with claim 1 wherein the electrically photosensitive marking particles are comprised of selenium or selenium alloys.

28. An imaging member in accordance with claim 2 wherein the electrically photosensitive marking particles are comprised of selenium or selenium alloys.

29. An imaging member in accordance with claim 3 wherein the substrate is a transparent polymer.

30. An imaging member in accordance with claim 1 wherein the substrate is a transparent polyester.

31. An imaging member in accordance with claim 1 wherein the substrate is of a thickness of from about 6 to about 200 micrometers.

32. An imaging member in accordance with claim 1 wherein the softenable layer is of a thickness of from about 1 to about 25 micrometers.

33. An imaging member in accordance with claim 2 wherein the softenable layer is of a thickness of from about 1 to about 25 micrometers.

34. An imaging member in accordance with claim 20 wherein the $D_{min}$ is from about 0.05 to about 0.08.

35. An imaging member in accordance with claim 1 wherein the electrically conductive polymers are selected from the group consisting of sulfonic acids, polystyrene sulfonic acids, polyvinyl toluene sulfonic acids, salts, polyvinyl sulfonic acids, polyacrylic acid salts, polymethacrylate acid salts, polyacrylic acid salts, polymethacrylic acid salts, maleic acid-acrylic acid copolymer salts, maleic acid-vinyl ether copolymer salts, and polyvinylphosphonic acid salts, di-tertiary-amines, polyvinyl trimethyl ammonium chloride, polyallyl trimethyl ammonium chloride, poly(vinylbenzyltrimethyl ammonium chloride), and poly(N-methyl-pyridinium chloride).

36. An imaging member in accordance with claim 1 wherein the softenable layer is selected from the group consisting of styrene acrylates, styrene methacrylates, and terpolymers thereof.

37. An imaging member in accordance with claim 2 wherein the softenable layer is selected from the group consisting of styrene acrylates, styrene methacrylates, and terpolymers thereof.

38. An imaging member in accordance with claim 1 wherein the softenable layer is comprised of styrene-co-n-hexylmethacrylate, styrene ethylacrylate acrylic acid terpolymer, or styrene butylmethacrylate.

39. An imaging member in accordance with claim 2 wherein the softenable layer is comprised of styrene-co-n-hexylmethacrylate, styrene ethylacrylate acrylic acid terpolymer, or styrene butylmethacrylate.

40. An imaging member in accordance with claim 1 wherein the softenable layer is comprised of a polymer and a solvent.

41. An imaging member in accordance with claim 2 wherein the softenable layer is comprised of a polymer and a solvent.

42. An imaging member in accordance with claim 1 wherein the softenable layer is comprised of a mixture of styrene ethylacrylate copolymer and methyl ethyl ketone solvent, styrene hexylmethacrylate copolymer and methyl ethyl ketone solvent, styrene hexylmethacrylate copolymer and ethyl acetate solvent, styrene hexylmethacrylate copolymer and diethyl ketone solvent, styrene hexylmethacrylate copolymer and methylene chloride solvent, styrene butylmethacrylate and 1,1,1-trichlorethane solvent, styrene hexylmethacrylate copolymer and mixture of toluene and isopropanol solvents, styrene butadiene copolymer and mixture of ethyl acetate, and butyl acetate solvents.

43. An imaging member in accordance with claim 1 containing an overcoating.

44. An imaging member in accordance with claim 2 containing an overcoating.

45. An imaging member in accordance with claim 43 wherein the overcoating is of a thickness of from about 0.5 to about 2 micrometers.

46. An imaging member in accordance with claim 43 wherein the overcoating is selected from a group consisting of acrylic styrene copolymers, methacrylate polymers, methacrylate copolymers, styrene butyl methacrylate copolymers, butylmethacrylate resins, vinylchloride copolymers, fluorinated homo or copolymers, high molecular weight polyvinyl acetate, organosilicon polymers and copolymers, polyesters, polycarbonates, polyamides, and polyvinyl toluene.

47. An imaging member in accordance with claim 7 wherein n is a number of from about 10 to about 1,000.

48. An imaging member in accordance with claim 10 wherein n is a number of from about 10 to about 1,000.

49. An imaging member in accordance with claim 5 wherein the sulfonated polystyrene is of the formula

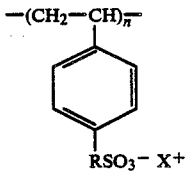

wherein R is an aliphatic or aromatic group, X is an anion, and n represents the number of monomer segments.

50. An imaging member comprised of a supporting substrate, in contact therewith an ionically conductive film forming polymer comprised of a sulfonated polystyrene, and in contact with the conductive film an electrically insulating softenable layer comprising a fractionable layer of electrically photosensitive migration marking particles.

51. An imaging member in accordance with claim 50 wherein the transparent conductive sulfonated layer is of a thickness of from about 0.2 to about 4 micrometers.

52. An imaging member in accordance with claim 1 wherein the ionically conductive film forming polymer is situated between a supporting substrate and the electrically insulating softenable layer.

53. An imaging member in accordance with claim 2 wherein the ionically conductive film forming polymer is situated between a supporting substrate and the electrically insulating softenable layer.

54. An imaging member in accordance with claim 7 wherein R is an alkyl or aryl group.

55. An imaging member in accordance with claim 7 wherein X is selected from the group consisting of hydrogen and metals.

56. An imaging member in accordance with claim 55 wherein the metals are selected from the group consisting of sodium, lithium, and potassium.

57. An imaging member in accordance with claim 56 wherein n represents a number of from about 10 to about 10,000.

58. An imaging member in accordance with claim 10 wherein n represents a number of from about 10 to about 10,000.

59. An imaging member in accordance with claim 10 wherein X is selected from the group consisting of hydrogen, ammonium, sodium, lithium, and potassium.

60. An imaging member in accordance with claim 10 wherein R is an alkyl or aryl group with from 6 to about 24 carbon atoms.

* * * * *